US005880402A

United States Patent [19]

Nugent

[11] Patent Number: 5,880,402

[45] Date of Patent: Mar. 9, 1999

[54] HIGH FIDELITY AUDIO INTERCONNECT CABLE

[76] Inventor: Steven Floyd Nugent, 3240 NW. 132 Pl., Portland, Oreg. 97229

[21] Appl. No.: 685,956

[22] Filed: Jul. 22, 1996

[51] Int. Cl.[6] ..... H01B 11/02

[52] U.S. Cl. ..... 174/27; 174/28

[58] Field of Search ..... 174/27, 28, 102 R, 174/68.3, 113 AS, 126.3

[56] References Cited

U.S. PATENT DOCUMENTS

| | | | |
|---|---|---|---|
| 680,150 | 8/1901 | Hultman | 174/27 |
| 716,155 | 12/1902 | West | 174/27 |
| 2,034,026 | 3/1936 | Curtis et al. | 178/44 X |
| 2,034,033 | 3/1936 | Green et al. | 178/44 X |
| 2,119,853 | 6/1938 | Curtis | 174/44 X |
| 2,188,755 | 1/1940 | Markuson | 173/244 X |
| 2,510,358 | 6/1950 | Wolf | 174/28 |
| 2,566,335 | 9/1951 | Joerren | 201/63 X |
| 3,249,901 | 5/1966 | Spinner | 333/96 X |
| 3,306,793 | 2/1967 | Gill et al. | 156/54 X |
| 3,892,912 | 7/1975 | Hauck | 174/68.3 |
| 4,319,074 | 3/1982 | Yaste et al. | 174/116 X |
| 4,439,632 | 3/1984 | Aloisio, Jr. et al. | 174/106 D X |
| 4,450,317 | 5/1984 | Baskwell et al. | 174/27 |
| 4,533,787 | 8/1985 | Anderegg et al. | 174/68.5 |
| 4,758,685 | 7/1988 | Pote et al. | 174/28 |
| 4,767,890 | 8/1988 | Magnan | 174/28 |
| 4,954,095 | 9/1990 | Cogan | 439/284 |

FOREIGN PATENT DOCUMENTS

| | | | |
|---|---|---|---|
| 664243 | 4/1937 | Germany | 174/27 |
| 218975 | 12/1924 | United Kingdom | 174/27 |
| 462532 | 3/1937 | United Kingdom | 174/27 |

*Primary Examiner*—Kristine L. Kincaid
*Assistant Examiner*—Chau N. Nguyen

[57] ABSTRACT

Uniformly spaced insulating buttons support two signal conductors within a tubular cable. The signal conductors are twisted from 180 to 360 degrees and are in physical contact with each other at their crossing point between each pair of buttons. Between each pair of buttons one of the conductors is covered with an insulating sleeve. The insulating sleeve alternates from one conductor to the other over the length of the cable. The conductors and buttons are enclosed within an insulating and supporting tubing. The supporting tubing is reduced in diameter or has corrugations to provide flexibility between each pair of insulating buttons. An overall shield composed of wires or foil is woven or helically wrapped to form a straight tube that surrounds the supporting tubing. The overall shield is electrically connected to system ground at the source end, allowing current flow only in the signal conductors. The signal conductors are electrically connected at both the source and destination ends, providing a foreward and return current path for the signal.

2 Claims, 12 Drawing Sheets

(Section I-I)
Prior Art (Section II-II)
Prior Art (Section III-III)

HIGH FIDELITY AUDIO INTERCONNECT CABLE

BACKGROUND OF THE INVENTION

1. Field of the Invention

The present invention relates to the field of audio electronics, and in particular to cables for the transmission of line-level analog audio signals.

2. Description of the Related Art

High quality high-fidelity components used for music reproduction such as preamplifiers, amplifiers, digital-to-analog converters and tuners often employ analog signaling to convey the music signal from one component to the next.

Signal degradation can occur in interconnects that convey signals between these components due to the interaction of the signal conductors with the driving and receiving components. A number of measurable interconnect parameters can contribute to this degradation including: inductance, capacitance, dielectric absorption, dielectric loss, bandwidth and susceptibility. It is desirable to optimize these parameters in order to minimize degradation of the signal as it is conveyed from one component to the next.

An optimum interconnect should achieve low capacitance and inductance, uniform low-loss dielectric (preferably air), some form of shielding or common-mode noise rejection, have the ability to be terminated with standard RCA plugs or XLR connectors and have mechanical flexibility.

Line-level single-ended signaling generally involves a component containing a driver with an impedance in the range of 7–300 ohms which drives a signal over a cable or interconnect which terminates at a receiver in a second component with an impedance in the range of 10–75K ohms. Due to the small output signal voltages and high input impedances, the resulting currents are very small. Because of the high impedance of the receiver and the relatively high output impedance of the driver, capacitance and inductance in the interconnect can limit the bandwidth of the transmission system. It is therefore an objective to achieve the lowest possible inductance and capacitance in a single-ended interconnect. To accomplish this, tradeoffs must be made between: 1) spacing the conductors close together as in a twisted-pair to achieve low inductance, and 2) separating the conductors with air spacers to achieve low capacitance. As the inductance is reduced, the capacitance increases. Likewise, when the capacitance is reduced the inductance generally increases. There are also practical physical limits to spacing the conductors in order that the cable remain flexible and convenient to use in a system. An optimum balance of capacitance and inductance combined with uniform low-loss dielectric is required to achieve a theoretically ideal interconnect.

Balanced line-level interconnects also benefit from low capacitance and inductance although the drivers used for balanced signaling are generally lower impedance, typically in the range of 7–50 ohms, and the load is standardized with a termination of 600–1K ohms, which makes the interconnect less sensitive to these parameters.

Non-uniform or lossy dielectrics surrounding the conductors of the interconnect can cause phase shifts and noise in the signal that vary with frequency. These phenomena are generally manifested as what has been described as "veils" over the reproduced music material as reported from empirical study. These phase shifts and self-generated noise can also cause a defocusing of the image in the reproduced music program. This phenomena has been attributed to several mechanisms including conductor stranding effects, "skin effects" and imperfect dielectrics which are lossy and exhibit dielectric absorption. Dielectric absorption and dielectric losses can affect the signal by not allowing the interconnect to completely charge and discharge with transient musical passages.

In order to minimize the inductance, it would seem to be advantageous to utilize large gauge conductors in interconnects, however there is a practical upper limit because of "skin effects". Skin effects are present due to the wide band of frequencies that are present in most high-fidelity music material. The currents associated with the low frequencies tend to travel deeper within the cross-section of the conductor than the high frequencies which tend to travel more on the outer surface skin of the conductor. This is known as skin-effect. Skin effect is a function of the conductor material and geometry. Skin-effect can cause the music signal to become attenuated at some frequencies and distorted or smeared due to changing phase as the frequency changes. To minimize this attenuation and phase distortion, the currents of all frequencies of the audio spectrum can be forced to flow through the same media and have the same uniform dielectric around them. One method that has been used to accomplish this is to limit the gauge of the conductors so that the skin depth of the currents at the highest frequencies completely penetrate the conductors. The optimum gauge using copper has been analytically and empirically determined to be between 0.5 and 1 mm diameter. In order to further reduce inductance and resistance without increasing skin effects larger diameter hollow conductors have been used in some interconnects. These constructions confine the current flow at all frequencies mechanically.

The veiling affects are more noticeable in the high-frequency audio range although the defocusing effect of transients can give the impression of affecting mid-frequencies. Two manufacturers have eliminated the veils and defocusing in their products by inserting low-pass filters in the interconnect. This approach does seem to eliminate the veils, but at the expense of high-frequency response. Reproduction of cymbals and other high-frequency material tends to be compromised in the process.

Other interconnects locate hollow insulating tubing around and between the conductors to lower capacitance and capture more air in the dielectric. The capacitance and dielectric absorption can both be reduced by creating air spaces around the conductors.

There are currently five types of geometries utilized in high-fidelity single-ended and balanced cables, the coaxial, the twisted-pair, the parallel-pair, the woven and the helical-pair. The simplest geometry used in single-ended interconnects is a coaxial arrangement. This geometry locates the forward signal conductor at the concentric center of an overall shield. The shield is usually composed of a large number of fine wires woven into a tubular shape or wrapped in a helical fashion. The return signal current flows in the overall shield. To lower the capacitance of this interconnect, low-dielectric constant materials have been utilized for insulation of the center conductor. Air pockets have also been introduced by spiraling a solid or tubular insulator around the center conductor. The disadvantage of the coaxial arrangement is that there is significant capacitive coupling between the entire surface of the inner conductor and the inside surface of the overall shield conductor. The current distribution in the shield is also very different than that in the inner conductor. Only one successful high-fidelity audio cable currently utilizes this geometry. This particular cable utilizes a center conductor that is tubular in geometry, which reduces skin-effect. It also utilizes air-filled dielectric material between the overall shield and the center conductor. This interconnect has the disadvantage that the large adjacent surfaces of the inner conductor and overall shield creates a highly capacitive cable. Most types of coaxial constructions tend to have poor phase linearity when used with consumer electronics.

A typical twisted-pair is illustrated in FIG. 1*a*. The twisted-pair geometry has the disadvantage that the close proximity of the conductors 101 tends to decrease inductance at the expense of increasing capacitance. The shield 102 is usually composed of a large number of fine wires woven into a tubular shape or wrapped in a helical fashion. Sometimes the shield is a spirally wrapped foil or combination of braid and foil. Because there is dielectric material directly between the conductors but air around both of them as a result of inserting air-filled materials, this creates a non-uniform lossy dielectric. Since the EM fields have the highest magnitude directly between the two signal conductors, the dielectric absorption and losses of the insulating material can affect the signal quality. To minimize this effect, some interconnects utilize expanded Teflon™ which contains a high-percentage of air or other inert gases to insulate the conductors. This achieves a very low-capacitance cable. However, these interconnects have been shown empirically to have lack of focus in the stereo image. Some filtering is required in these interconnects to eliminate the "veils" as well. The veils are reduced as compared to an interconnect utilizing standard un-expanded Teflon™. However, they are still present, it is believed, due to dielectric absorption effects.

Some versions of twisted-pairs are unshielded and therefore achieve significant air dielectric around the conductors to minimize capacitance, however they are more susceptible to noise. Versions with overall shields are not as susceptible to noise but the capacitance tends to be increased due to elimination of air in the dielectric and coupling of the signal conductors to the shield, causing the high-frequencies to roll-off.

Illustrated in FIG. 1*b*, the helical-pair geometry used in some interconnects comprises a helical wrap of two signal conductors 103 around a large Teflon™ tubing core 104. In some cases, small hollow tubing is also helically wrapped around the tubing core to act as spacers, holding the conductors in place. Air dielectric is present on three sides of the conductors in this construction. Because the two conductors are spaced apart as they wrap around the core, this makes the interconnect susceptible to noise. Therefore, these types of interconnects typically have an overall shield 105 to reduce susceptibility. The shield is generally spaced away from the signal conductors by additional insulating material. This type of interconnect has three disadvantages. First, only three sides of the signal conductors are adjacent to the air dielectric. Second, both signal conductors capacitively couple to the overall shield, which in most cases is spaced fairly close, causing increased capacitance. Third, the conductors are generally located on opposite sides of the tubing core, causing the interconnect to be inflexible and susceptible to mechanical damage. Bending the cable causes one signal conductor to stretch as the other is compressed.

FIG. 1*c* illustrates a woven geometry. The braided weave causes air to be interlaced between the conductors reducing the capacitance. The woven geometry has the disadvantage that it is susceptible to noise and that the forward and return paths are not identical. Noise susceptibility is high because the geometry is not twisted and therefore common-mode noise is not effectively canceled. No combination of two of the three signal conductors forms a twisted-pair geometry. The absence of an overall shield also tends to increase noise susceptibility. All three conductors are used for signal transmission in the woven geometry. This causes the geometry of the forward signal path to be different than the return signal path. Due to the differing geometry of the forward and return paths, electromagnetic field coupling between conductors can cause undesired currents to be induced. The effect has been empirically shown to be a defocusing of the stereo image forming a "musical soup", particularly noticeable at high frequencies.

Parallel-pair constructions suspend two parallel conductors within an overall shield. One version of the parallel-pair interconnect is shown in U.S. Pat. No. 4,954,095 of Cogan. Two parallel hollow solid copper conductors are shown being supported using spacers that suspend the signal conductors in an air dielectric. This creates air-filled spaces 180 degrees around the conductors and between the signal conductors and the overall shield. This construction minimizes capacitance and creates a uniform low-loss dielectric. It also has the advantage of utilizing a single identical conductor each for forward and return currents. The disadvantage of this interconnect is that it has limited flexibility in one dimension and is inflexible in the other dimension. The use of solid conductors causes the interconnect to be quite stiff and must be "formed" into the desired shape. It is also difficult to terminate this cable to conventional RCA and XLR type audio connectors. Manufacture of this cable is also very difficult to mechanize, increasing the cost. Constructions such as that utilized in Cogan use spacers to suspend the conductors in air which approaches the ideal combination of uniform air dielectric, low capacitance between combinations of conductors and shield, and low inductance. Low inductance is achieved in this case by using large gauge hollow single conductor tubing as opposed to twisting the signal conductors together.

The disadvantage of this and other existing spacer constructions is that they tend to be very inflexible, fragile and are difficult to terminate to RCA or XLR connectors.

Another version of the parallel-pair is shown in U.S. Pat. No. 4,767,890 of Magnan. The Magnan cable is actually a combination of two helically wrapped singles to form a parallel pair. This interconnect succeeds in creating air gaps around the signal conductors which creates a uniform low-loss dielectric. Skin-effects are eliminated by utilizing a multiplicity of small individually insulated conductors to convey the signal. The conductors in the Magnan cable are arranged in such a way as to approximate two tubular conductors that are parallel to each other. This technique has the disadvantage that it allows differences in group-delay to occur between conductors and non-linearities in phase response due to non-uniform current-sharing across all conductor strands. It is preferred to utilize a single identical conductor for each signal direction to avoid current-sharing and the need to electrically equalize all conductor lengths. The Magnan cable has the added disadvantage of having restricted mechanical flexibility, particularly in one dimension. It is also difficult to terminate to RCA and XLR connectors.

Yet another example of a parallel-pair that is suspended in a gaseous dielectric is described in U.S. Pat. No. 2,034,033 of E. I. Green and H. E. Curtis. Green and Curtis describe a transmission-cable composed of a series of dielectric washers that hold two conductors at a specified spacing from each other inside an overall circular shield. The two conductors are twisted helically about the axis of the shield. The spacing relationships between the conductors and shield are critical to Green and Curtis for achieving low attenuation at high frequencies. The disadvantage of this construction is that the conductors cannot maintain their spacing relationship when the cable is severely flexed. The cable cannot withstand severe bends without compromising the conductor spacing or otherwise displacing the conductors from their optimum positions. The cable of Green and Curtis is also inflexible because the outer jacketing does not contain features which allow severe bending, such as corrugations.

None of the interconnect constructions described achieve an optimum balance of low capacitance and inductance, uniform low-loss dielectric, compatibility with standard RCA or XLR plugs, and mechanical flexibility that allows severe bending without altering the relationship of the conductors.

SUMMARY OF THE INVENTION

The present invention finds application in the field of high-fidelity audio, and particularly to line-level analog interconnects between audio components.

It is a general object of the present invention to provide an improved means for conveying line-level signals between consumer audio components. More specifically, it is an object of the present invention to provide a transmission media for audio signals that causes minimal degradation to the audio signal, at the same time providing the mechanical flexibility to allow sharp bends and compatibility with XLR and RCA-type connectors.

Briefly, the present invention is an interconnect for conveyance of a single channel of audio signal that includes a forward signal conductor, a return signal conductor and an overall shield. On a single-ended version, the overall shield is connected to the ground or return conductor only at the source end. On a balanced version, the overall shield is connected to the ground at both the source and destination end. The two signal conductors are suspended by insulating spacers which are spaced at uniform intervals and surrounded by an insulating tube. The insulating tube insulates the conductors from the overall shield. The two conductors are twisted with each other 180–360 degrees between each pair of spacers. At the points where the conductors cross between each spacer, they contact each other. The overall shield spans the length of the interconnect and surrounds the insulating tube. Both signal conductors are the same length, made of the same material and have identical insulation, which may not be continuous. The conductors are generally terminated at both ends of the cable into XLR connectors for balanced operation or RCA-type connectors for single-ended operation, but can utilize other types of connectors.

In accordance with one important aspect of the invention, the forward and return signal conductors cross-over and contact each other approximately half-way between each pair of insulating spacers where they are suspended. Insulation at the crossover points prevents the signal conductors from shorting to each other. At these crossover points, the conductors are substantially orthogonal, which minimizes the interconnect capacitance and conductor-to-conductor coupling. The fields generated by the two conductors are orthogonal, minimizing coupling. A mechanical improvement is also achieved by the conductor cross-overs. At each crossover, the interconnect can be bent severely in all directions without overly stressing the conductors or otherwise changing their relationship to each other or the shield. Due to the crossovers, bending the interconnect severely will not change its' characteristics.

In accordance with another important aspect of the invention, the insulating tubing is heat-shrinkable tubing that has controlled shrink characteristics that create corrugations between each insulating spacer as well as encasement and bonding of the insulating discs. The tubing is specified to shrink to a smaller diameter than the insulating spacers when heated, forming the corrugations. The corrugations occur at the same locations where the conductor cross-overs occur, forming a synergistic flexible joint. The tubing bonds to the insulating spacers when heated, by using thermally activated adhesives. These adhesives are applied either to the inside of the insulating tubing or the outer perimeter of the insulating spacers.

In accordance with yet another important aspect of the invention, the insulating tubing can consist of compliant tubing sections that are pre-formed with corrugations that surround the signal conductors between the insulating spacers. These tubing sections support the insulating spacers and provide insulation between the signal conductors and the overall shield. Each corrugated tubing section is bonded or mechanically attached to a pair of insulating spacers. The corrugations allow the interconnect to be highly flexible by allowing severe bends between each pair of insulating spacers.

In accordance with yet another important aspect of the invention, one of the signal conductors between each pair of insulating spacers is surrounded by an insulating sleeve and the other conductor is uninsulated. This sleeve has an inside diameter slightly larger than the conductor diameter and an outside diameter larger than the holes or slots in the insulating spacers. This sleeve prevents the two conductors from making electrical contact with each other. The insulating sleeves cannot pass-through the hole or slot in the insulating spacers, therefore they act to evenly separate the spacers. All sleeves in the interconnect are the same length, causing the insulating spacers to have a uniform spacing. The sleeves alternate from one conductor to the other on consecutive intervals between insulating spacers. This allows the number of insulating sleeves on the forward conductor to be identical to the number on the return conductor. An identical number of sleeves on both conductors is critical to insure that the dielectric effects are the same on both conductors.

The geometry of the conductors creates a twisted pair and maximizes the distance between the signal conductors and the overall shield while eliminating parallelism. At points where the signal conductors contact each other, they are orthogonal to each other. These orthogonal points allow the interconnect to be mechanically flexible. These physical features serve to minimize capacitance and inductance and provide good noise rejection without sacrificing mechanical flexibility and ability to terminate to XLR and RCA-type connectors.

Other objects, advantages and novel features of the present invention will become more apparent from the following detailed description of a preferred embodiment in conjunction with the accompanying drawings.

DETAILED DESCRIPTION OF THE INVENTION

The present invention is an audio interconnect for conveying audio signals between components of an audio system. These interconnects typically range in length from 0.5 meters to about 10 meters. Single-ended interconnects are generally terminated with RCA-type connectors at both ends. Balanced interconnects are generally terminated with XLR connectors at both ends.

Figure 1A:
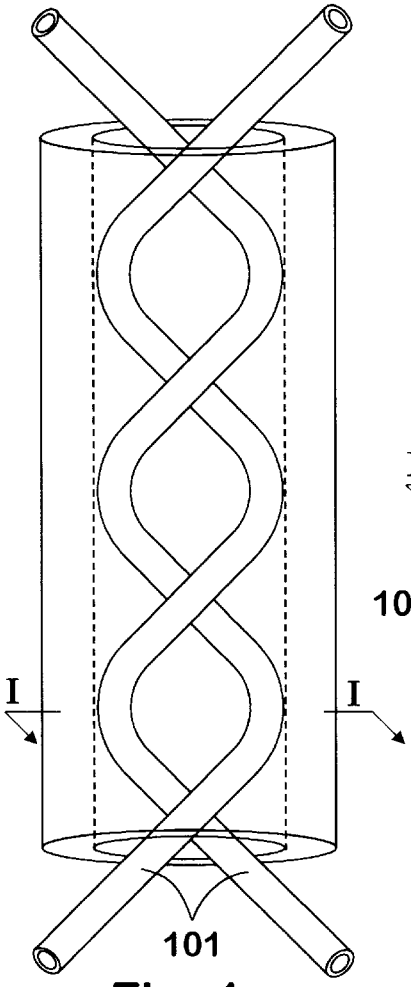
FIGS. 1*a*, 1*b* & 1*c* illustrate the geometry of three existing types of interconnects.
Figure 1B:
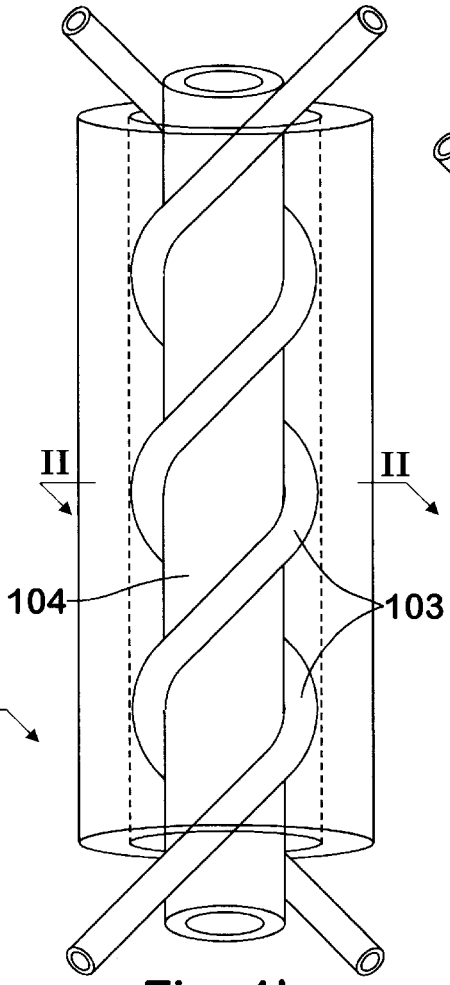
Figure 1C:
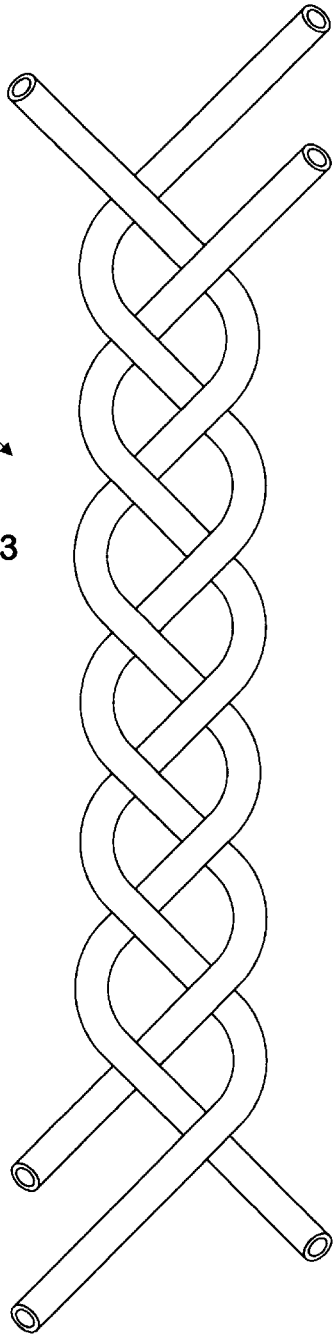
Fig. 1c Prior Art
Figure 1D:
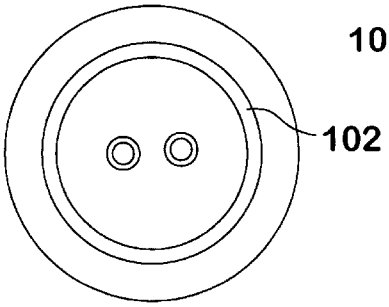
Figure 1E:
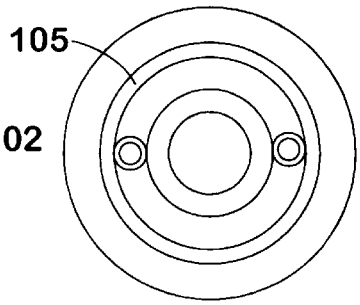
Figure 2:
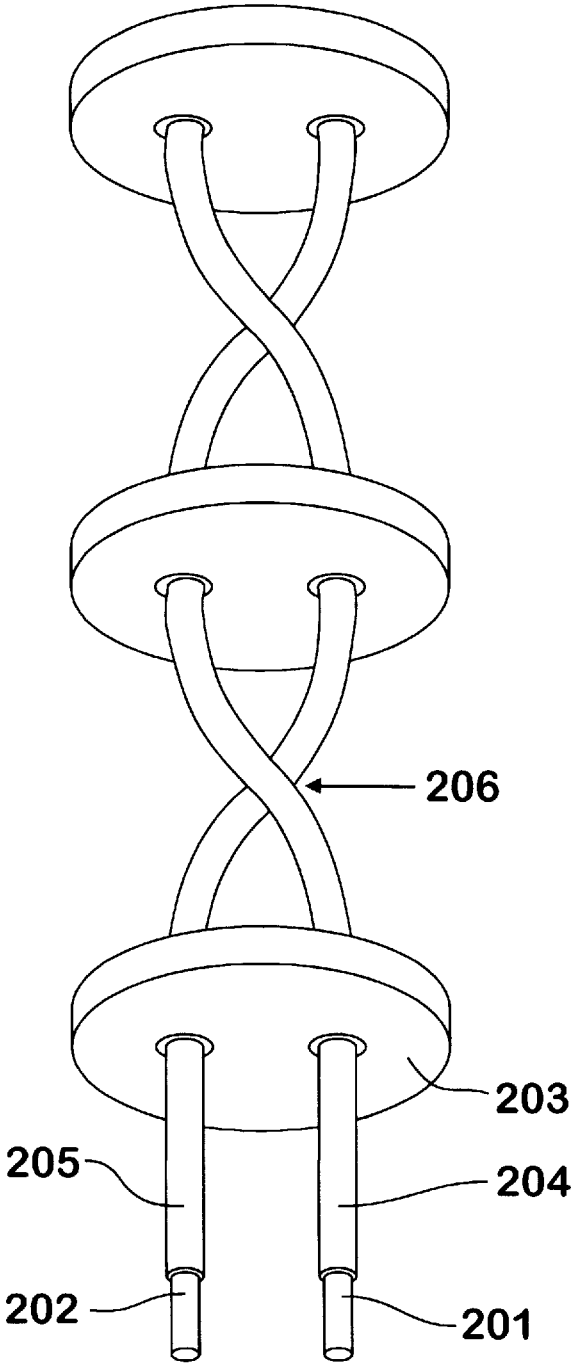
FIG. 2 illustrates the internal subassembly of the present invention.

The internal subassembly of the preferred embodiment of the present invention is illustrated in FIG. 2. Referring to FIG. 2, a forward signal conductor 201 and a return signal conductor 202 are supported and suspended in air by a series of round insulating button-shaped spacers 203. The spacers have two holes for passing the conductors. Between each insulating spacer the two conductors are rotated 180 degrees to form a half-twist. At the point where the two conductors cross between each pair of spacers 206, the conductors are in contact with each other. The spacers are held apart at equal intervals by the insulating sleeving 204 and 205 which are slipped over the conductors 201 and 202 respectively. The holes in the spacers are large enough to pass the conductors, but not the insulating sleeving.

Figure 3:
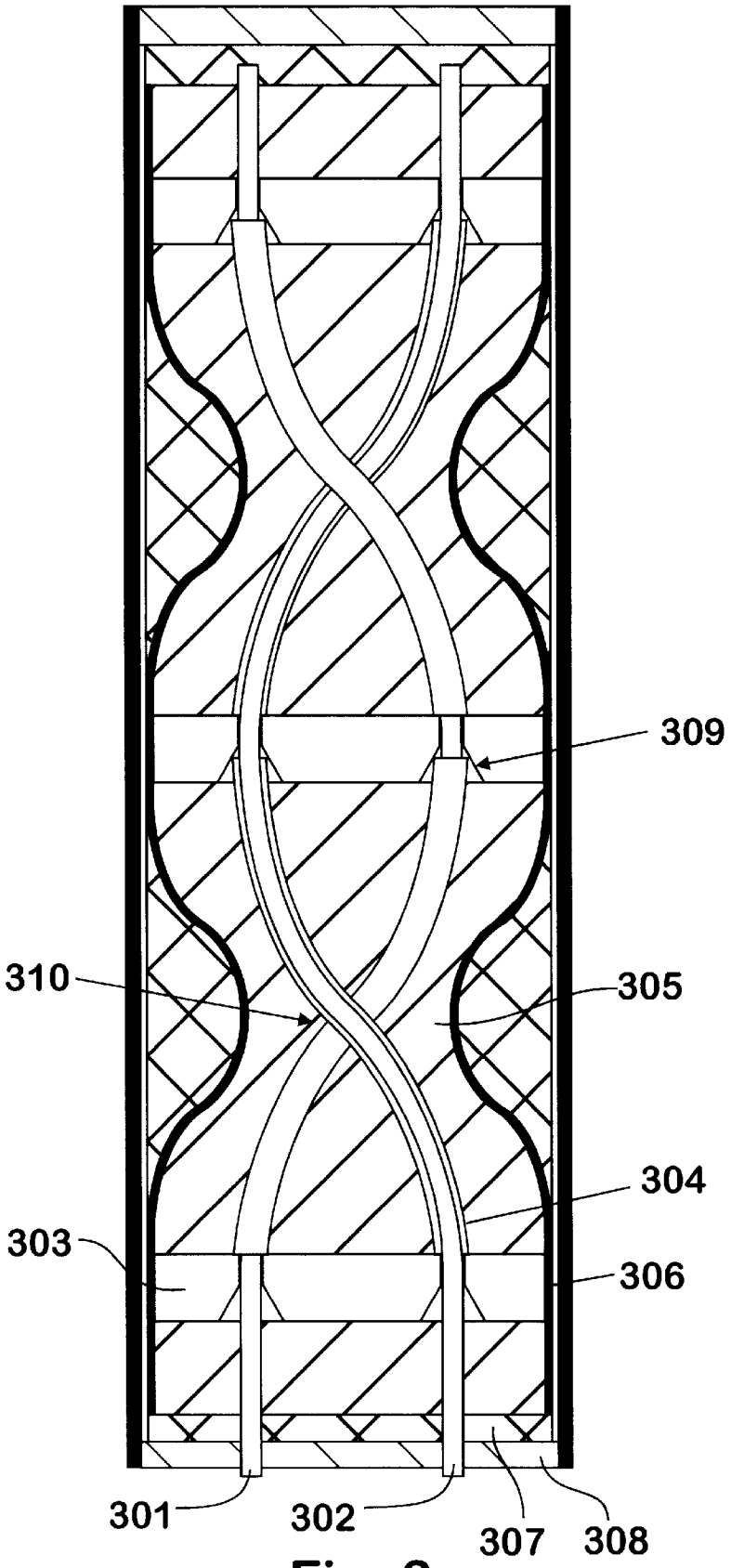
FIG. 3 illustrates a cutaway view of a completed assembly of the present invention utilizing continuous heat-shrinkable insulating tubing.

The internal subassembly of FIG. 2 can be used in several complete assemblies to be described, one of which is illustrated in the cutaway view in FIG. 3. Referring to FIG. 3, the subassembly consists of two conductors 301 and 302 passing through a series of spacers 303 which are surrounded by an insulating heat-shrinkable tubing 305. FIG. 3 shows conductor 302 as a cutaway view to illustrate the insulating sleeving. The heat-shrinkable tubing 305 has been heated and has shrunk to conform to the internal subassembly. The heat-shrinkable tubing 305 has controlled-shrink characteristics, which prevent it from shrinking less than a certain diameter, generally 50% of the diameter of the insulating discs. At the perimeter 306 of the spacers, thermally activated adhesive bonds the spacers to the inner wall of the heat-shrinkable tubing 305. The adhesive can be applied either on the perimeter of the spacers or the inner wall of the heat-shrinkable tubing prior to assembly. The heat-shrinkable tubing shown in FIG. 3 has shrunk to a diameter of approximately one-half that of the spacers. This allows the completed assembly to be flexible at the conductor cross-overs 310 while preventing the insulating tubing 305 from contacting the conductors 301 and 302. Surrounding the insulating tubing 305 is an overall shield 307 which may consist of a braided copper tubing comprising many fine strands or a spirally wrapped metallic foil or a combination of both. The overall shield 307 is surrounded by an insulating sheath 308, which may consist of a braided polyester or nylon webbing or alternatively may be a molded plastic covering. The button-shaped spacers 306 shown in FIG. 3 have countersunk holes 309 in them to allow easy insertion of the conductors.

Figure 4B:
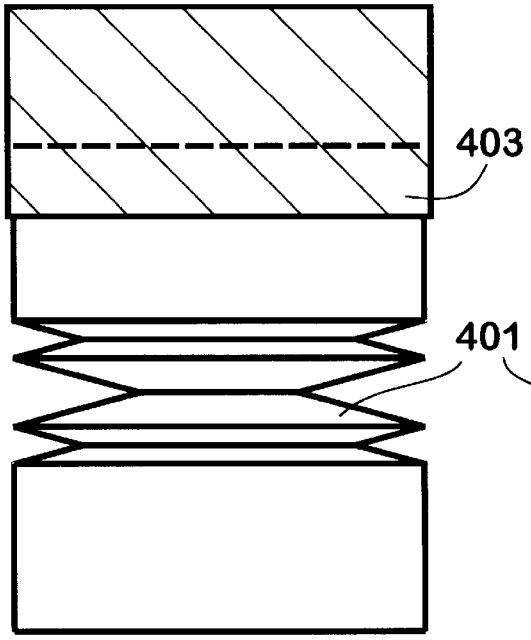
FIG. 4 illustrates a cutaway view of a completed assembly of the present invention utilizing flexible boots bonded in place by heat-shrinkable tubing sections.
Figure 4A:
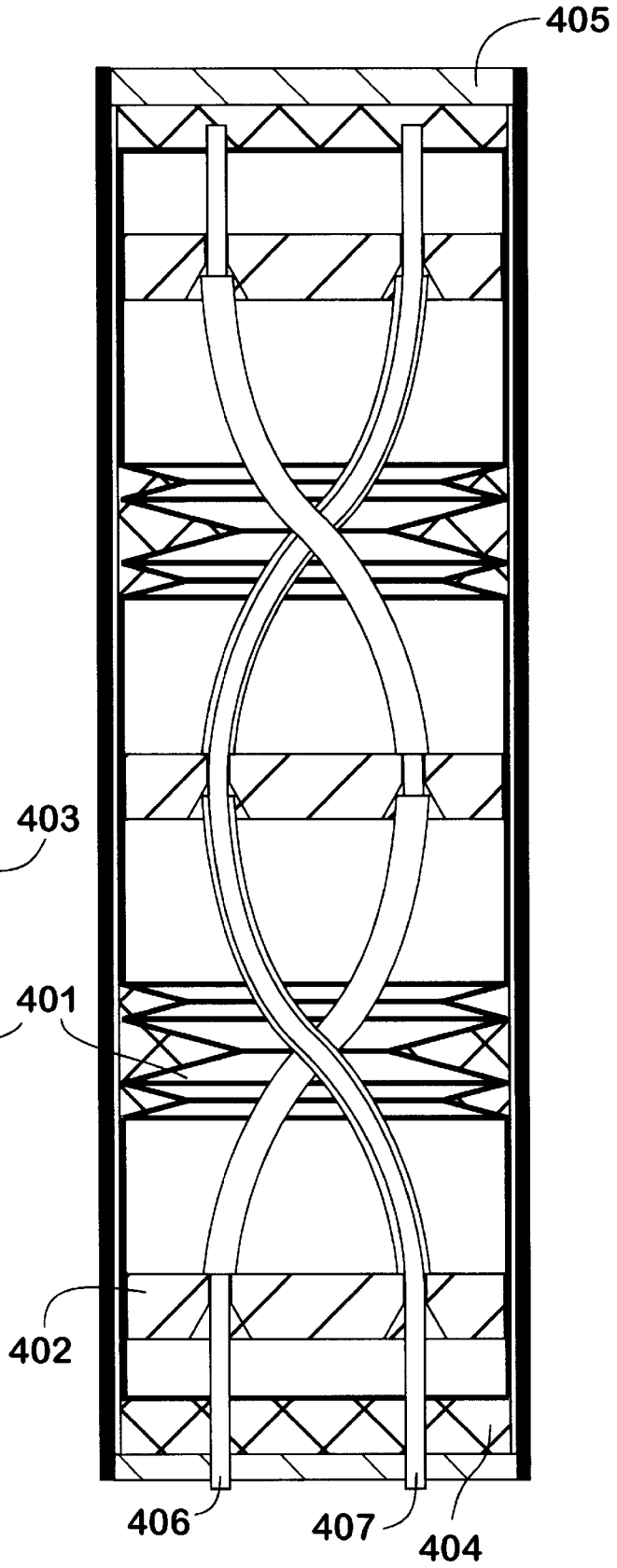
Figure 5D:
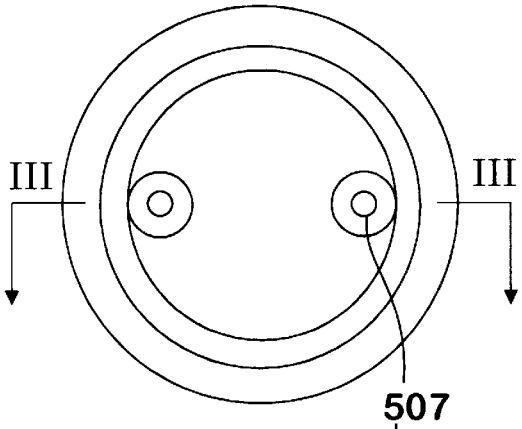
FIG. 5 illustrates a cutaway view of a completed assembly of the present invention utilizing flexible boots held in place by features on the spacers.
Figure 5C:
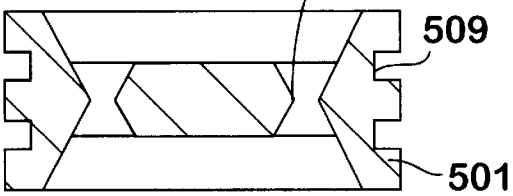
Figure 5B:
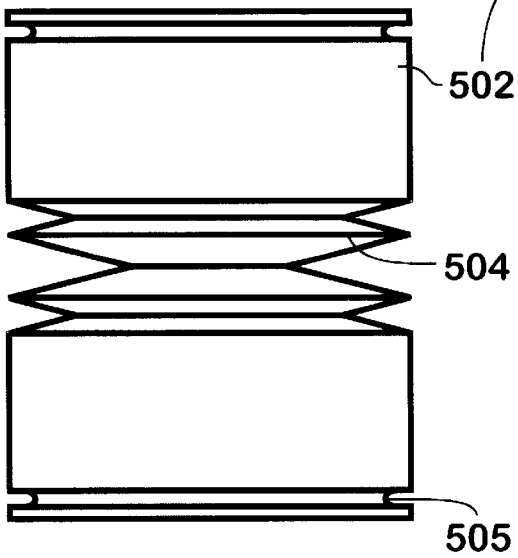
Figure 5A:
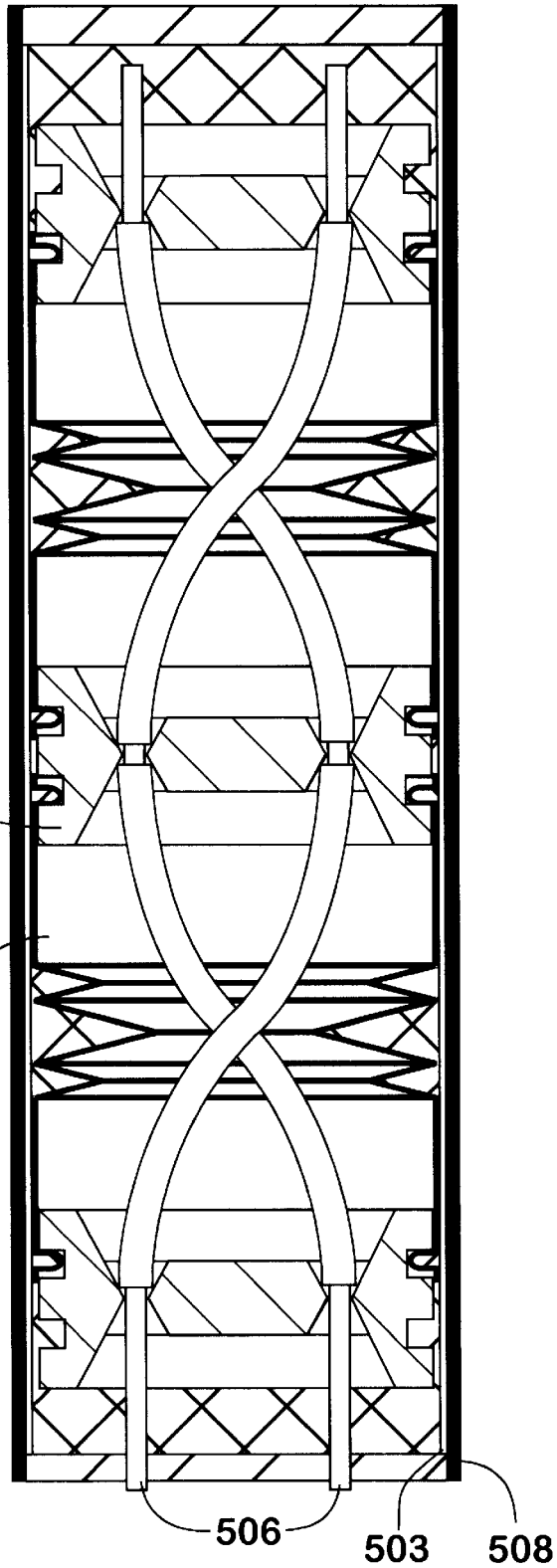

FIG. 4 illustrates a second version of a complete assembly that utilizes the subassembly of FIG. 2. Referring to FIG. 4, the insulating tubing of this version consists of sections of corrugated or compliant "accordion" tubing 401 that surround conductors 406 and 407 between each pair of spacers 402. These flexible corrugated sections 401 provide support for the conductor suspension spacers 402. The accordion tubes 401 are bonded to the spacers 402 by overlapping short sleeves of heat-shrinkable tubing 403 over the accordion tubes 401 and spacers 402. The heat-shrinkable tubing sleeve 403 has thermally activated adhesive on the inner surface. When a tubing sleeve 403 is thermally activated, it bonds one or two accordion tubes 401 to one spacer 402. When bonded, the compliant accordion tubes 401 support the spacers 402 and can flex freely giving the interconnect high flexibility. After the accordion tubing is installed, the overall shield 404 is installed, enclosing the accordion tubes and conductors. Finally, the insulating jacket 405 is installed enclosing the overall shield.

FIG. 5 illustrates a third version of a complete assembly. Referring to FIG. 5, the insulating tubing of this version consists of sections of accordion tubing 502 that surround the signal conductors 506 between each pair of the spacers 501. The accordion tubing 502 has features 505 that interlock with features 509 on the spacers 501. An overall shield 503 surrounds the accordion tube assembly. An insulating jacket 508 surrounds the shield 503. The holes 507 are tapered to ease installation on the signal conductors 506 and to minimize the amount of spacer material in direct contact with the signal conductors 506.

Figure 6:
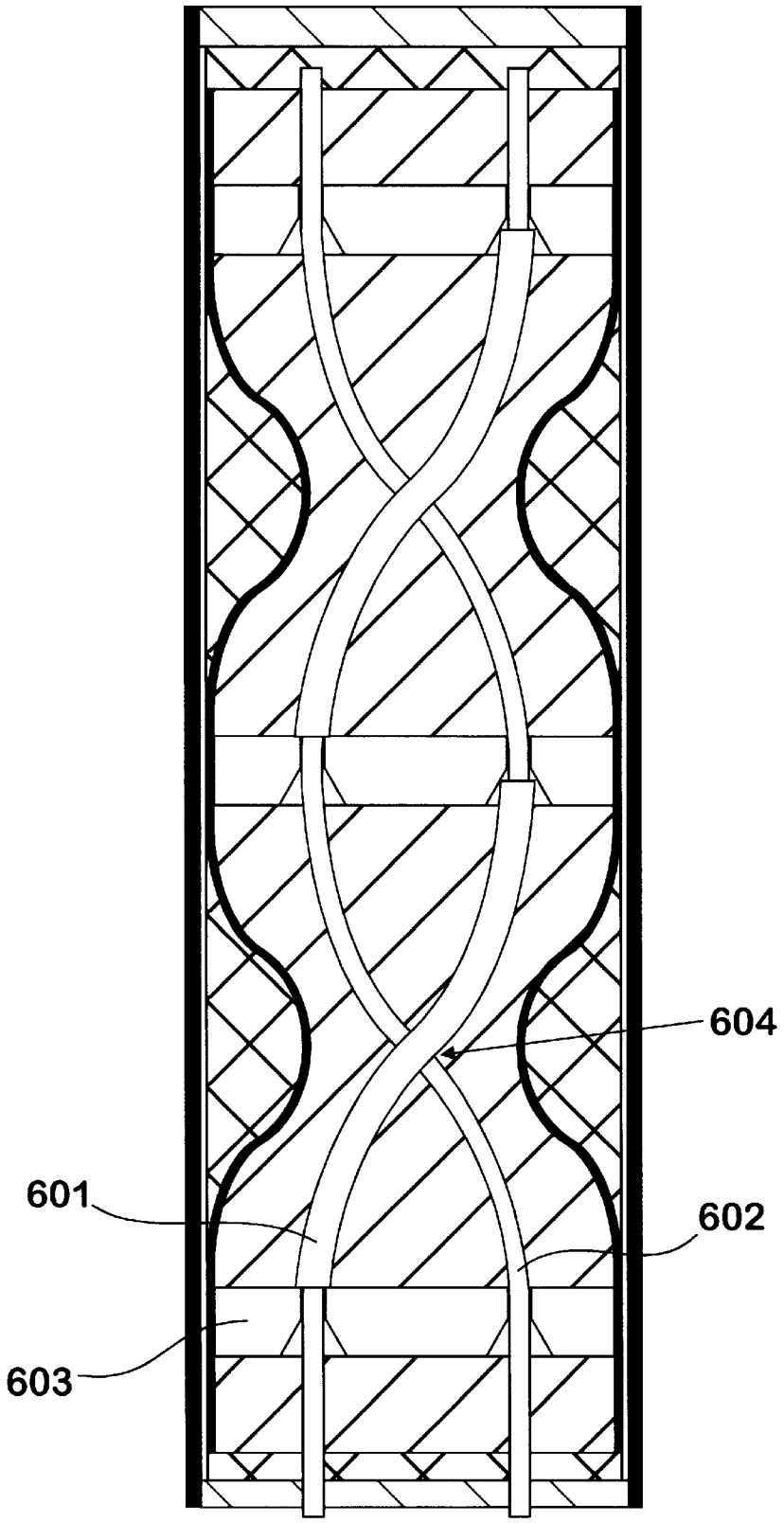
FIG. 6 illustrates a cutaway view of the best mode of the present invention wherein the insulators are alternated on the conductors.
Figure 7D:
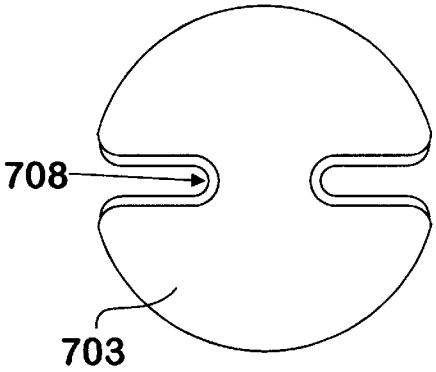
FIG. 7 illustrates an alternative embodiment of the internal subassembly utilizing spacers with slots to retain the conductors.
Figure 7C:
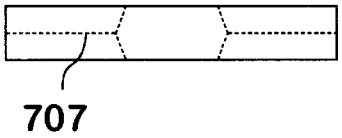
Figure 7B:
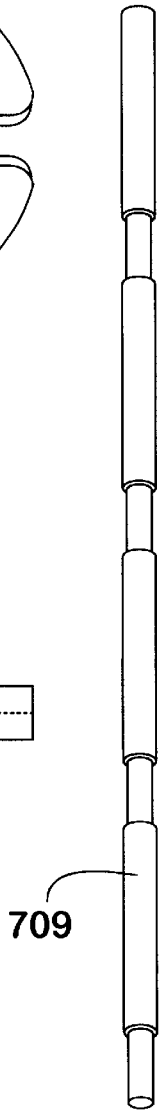
Figure 7A:
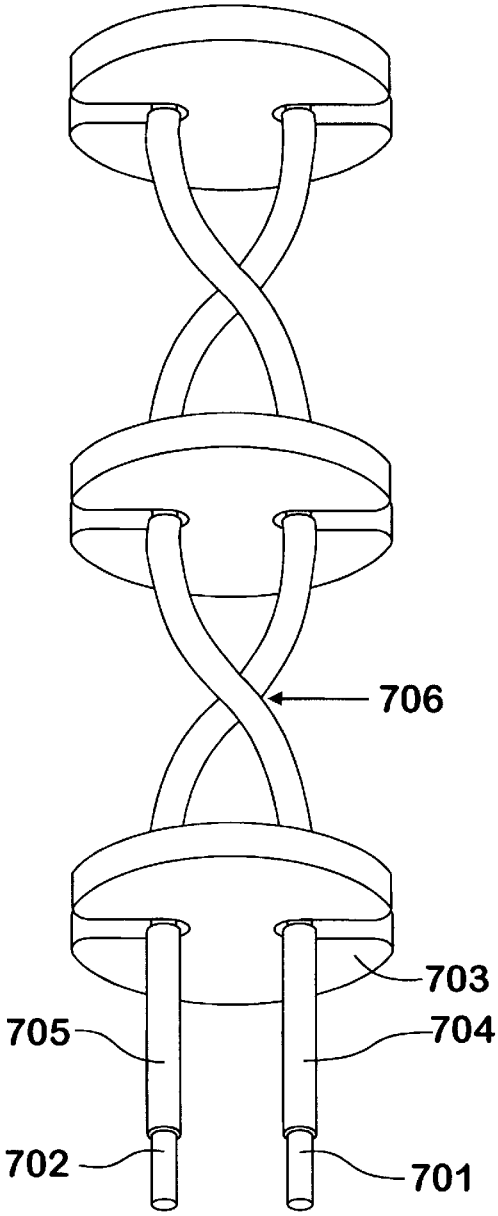

In order to further reduce the amount of synthetic dielectric material between the conductors, the internal subassembly illustrated in FIG. 6 may be used. This is the best mode of the invention. Referring to FIG. 6, the insulating tubing on one of the signal conductor segments 602 between the spacers 603 is omitted. The other conductor segment is covered with insulating tubing 601. Repeating this construction causes each conductor to have alternating insulating tubing and bare wire over its' length. This minimizes the insulation on the conductors while insulating them from each other at the intersections 604 where they contact each other. Each of the two signal conductors has identical numbers of insulated and exposed sections.

An alternate construction of the inner subassembly is illustrated in FIG. 7. In this version, the spacers 703 have slots 708 rather than holes for holding the signal conductors 701 and 702. The side view of the spacer 707 illustrates the "knife-edge" that grips the conductor where no insulation is present. Insulating tubing sections 704 and 705 are used to create uniform intervals between spacers. These insulating tubing sections can be formed by melting or mechanically removing small sections of insulation from an insulated conductor as shown in 709. The slotted spacers 763 can be installed on the conductors 709 without requiring the spacers and separate insulating sleeving to be threaded onto the conductors as in the construction of FIG. 2. The twist of the conductors 706 between each spacer 703 retains the spacers on the subassembly until overall insulating tubing and shielding can be installed.

An second alternate construction of the inner subassembly is illustrated in FIG. 12. In this version, the slotted insulating spacers 1203 are molded in a continuous string with flexible links 1207 spacing them at uniform intervals along the length of the interconnect. The signal conductors 1201 and 1202 are inserted into the slots 1208. The view of the spacer 1203 illustrates the "knife-edge" 1208 that grips the conductor. The insulation can optionally be stripped at even intervals 1204 along the insulated conductor 1205, but is not required in this construction because of the spacing effect of the integral flexible links 1207. The spacer molding 1203/1207 can be installed on the conductors 1201 and 1202 without requiring the support of the separate insulating sleeving of FIG. 2. The twist of the conductors 1206 between each spacer 1203 retains the conductors on the subassembly until overall insulating tubing and shielding can be installed.

Figure 8:
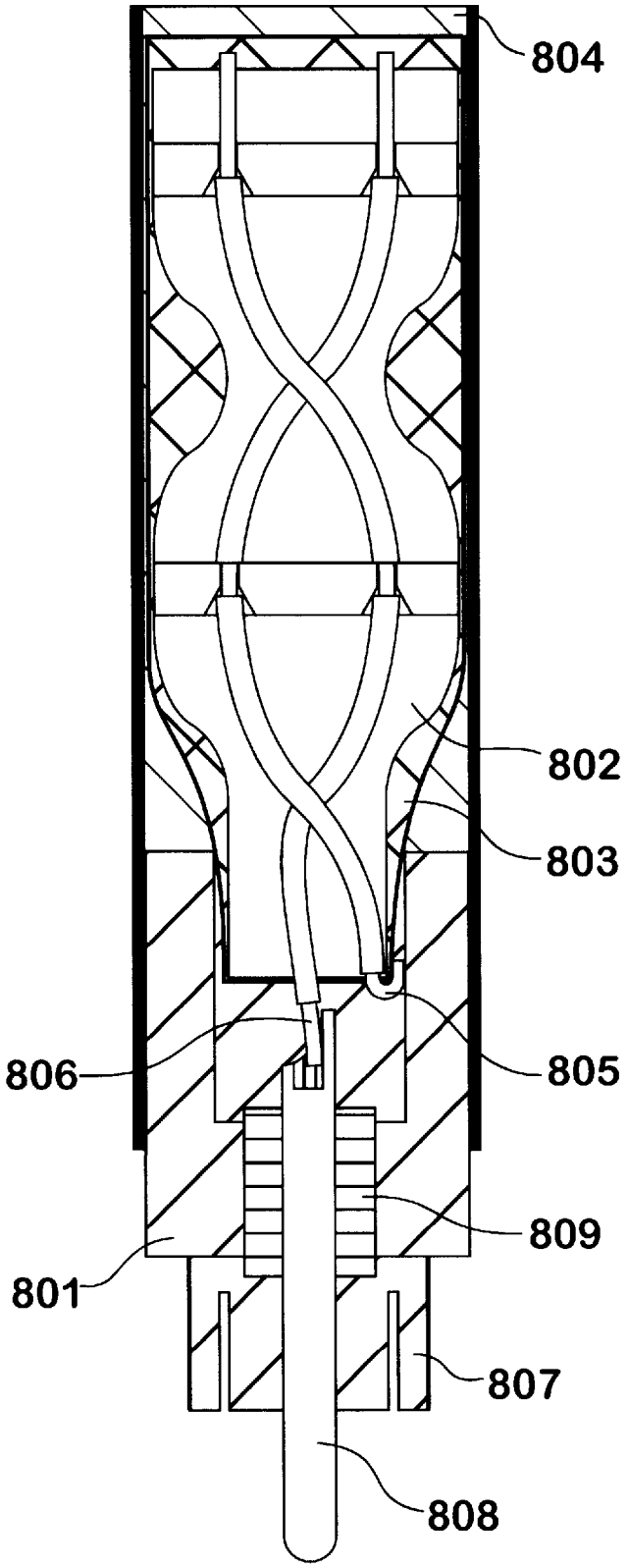
FIG. 8 illustrates a single-ended RCA termination at the source end of the present invention.

FIG. 8 illustrates a cutaway view of a single-ended RCA plug termination as applied to the designated source/driving end of the present invention. Referring to FIG. 8, the RCA-type connector 801 terminates both signal conductors 805, 806 and the overall shield 803. The forward signal conductor 806 is electrically connected to the center pin contact 808. The return signal conductor 805 is electrically connected to the coaxial contact 807 by connecting it to the connector body 801. The center pin contact 808 is insulated from the connector body 801 and coaxial contact 807 by an insulator 809. The overall shield 803 is electrically connected to both the return signal conductor 805 and the connector body 801. The overall shield diameter is narrowed and inserted into the connector body 801 to achieve a 360 degree contact with the connector body. The insulating tubing 802 prevents the strands of the overall shield from shorting to the forward signal conductor 806. The entire assembly is covered with insulating jacketing 804.

Figure 9:
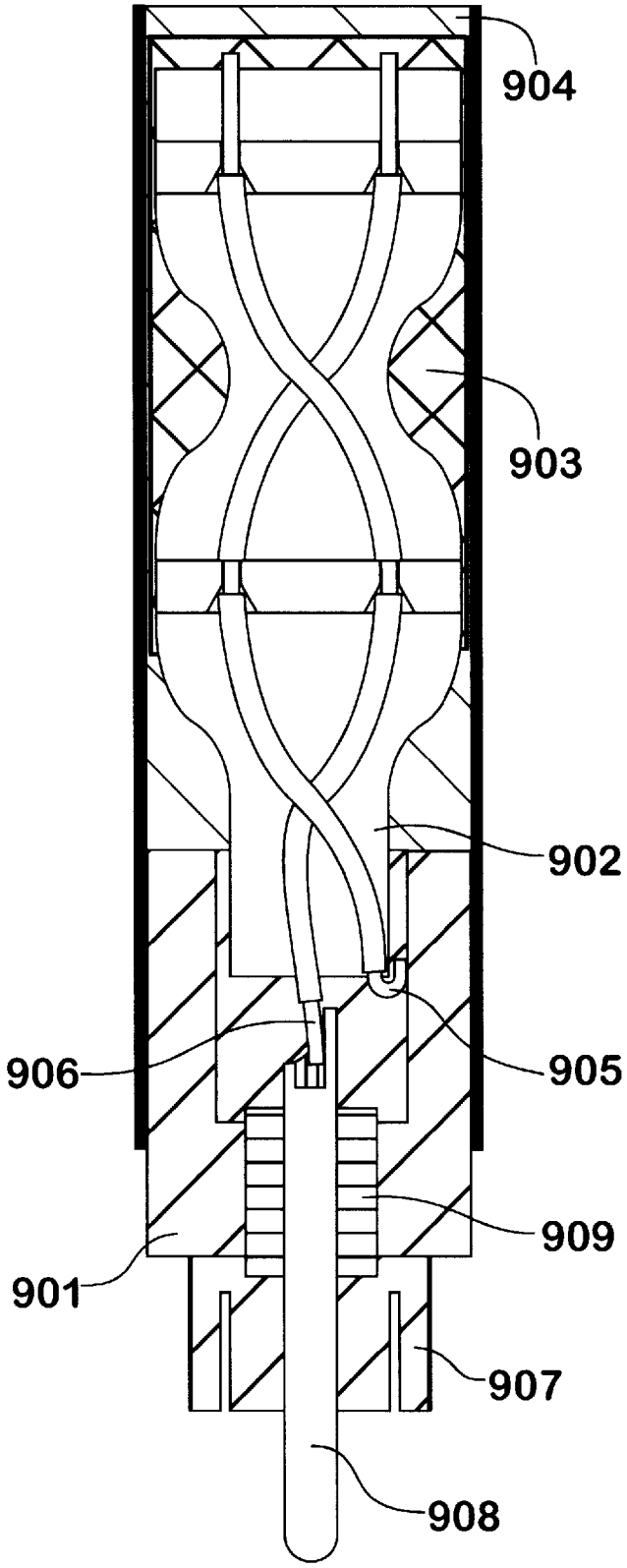
FIG. 9 illustrates a single-ended RCA termination at the destination end of the present invention.

FIG. 9 illustrates a cutaway view of a single-ended RCA plug termination as applied to the designated destination/receiving end of the present invention. Referring to FIG. 9, the RCA-type connector 901 terminates both signal conductors 905 and 906, but not the overall shield 903. The overall shield 903 is cut short of the connector body 901 which makes it electrically floating. The forward signal conductor 906 is electrically connected to the center pin contact 908. The return signal conductor 905 is electrically connected to the coaxial contact 907 by connecting it to the connector body 901. The center pin contact 908 is insulated from the connector body 901 and coaxial contact 907 by an insulator 909. The insulating tubing 902 prevents the strands of the overall shield from shorting to the forward signal conductor 906. The entire assembly is covered with insulating jacketing 904.

Figure 10:
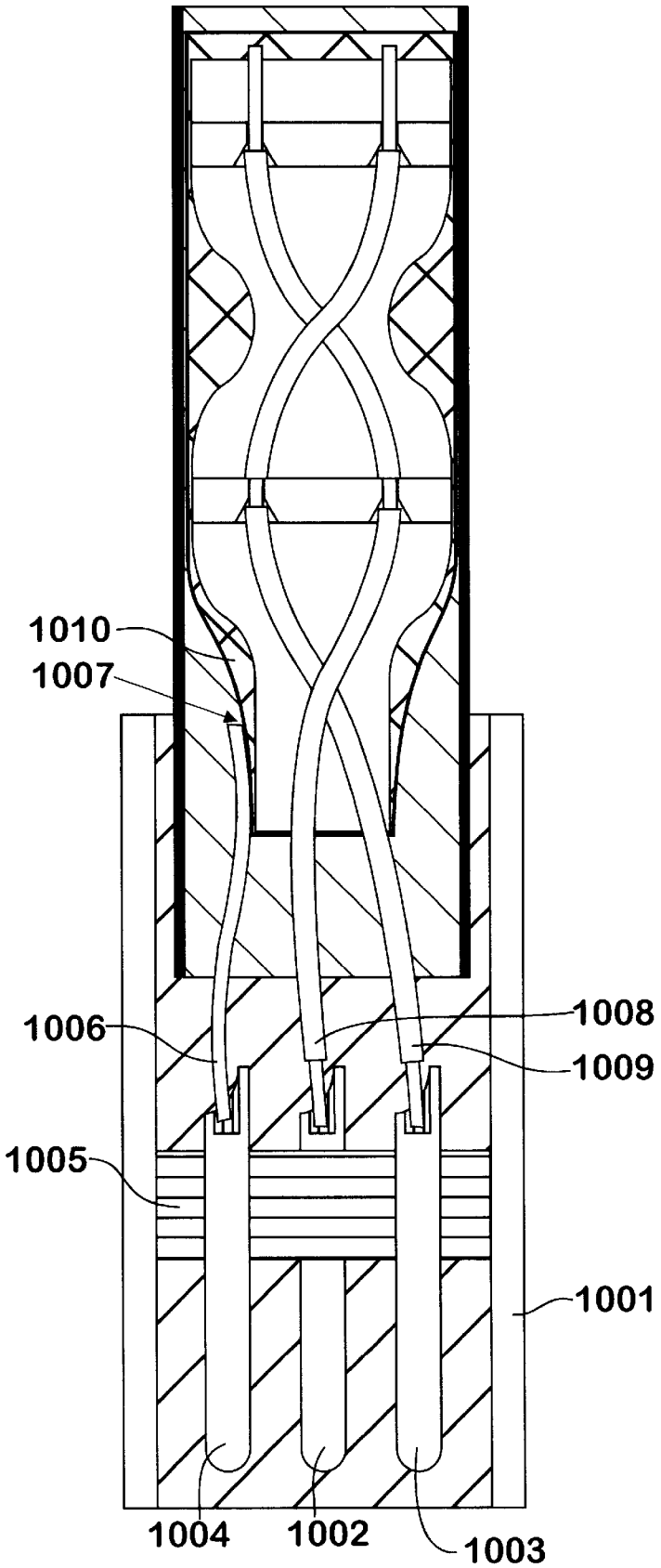
FIG. 10 illustrates a balanced male XLR termination to the present invention.

FIG. 10 illustrates a cutaway view of a balanced XLR connector termination as applied to the designated destination/receiving end of the present invention. Referring to FIG. 10, the male XLR-type connector 1001 terminates both signal conductors 1008 and 1009 and the overall shield 1010. Three contact pins 1002, 1003 and 1004 are held in an insulating slug 1005. The positive and negative signal conductors 1008 and 1009 terminate respectively into pins 1002 and 1003. The shield/ground conductor is terminated to pin 1004 using conductor 1006. Conductor 1006 is electrically connected to the shield 1010 at 1007. Some types of shields already have an integral drain-wire. In this case, the drain wire is terminated to pin 1004. Other shields are composed entirely of helically wrapped wires. These can generally be directly terminated to pin 1004.

Figure 11:
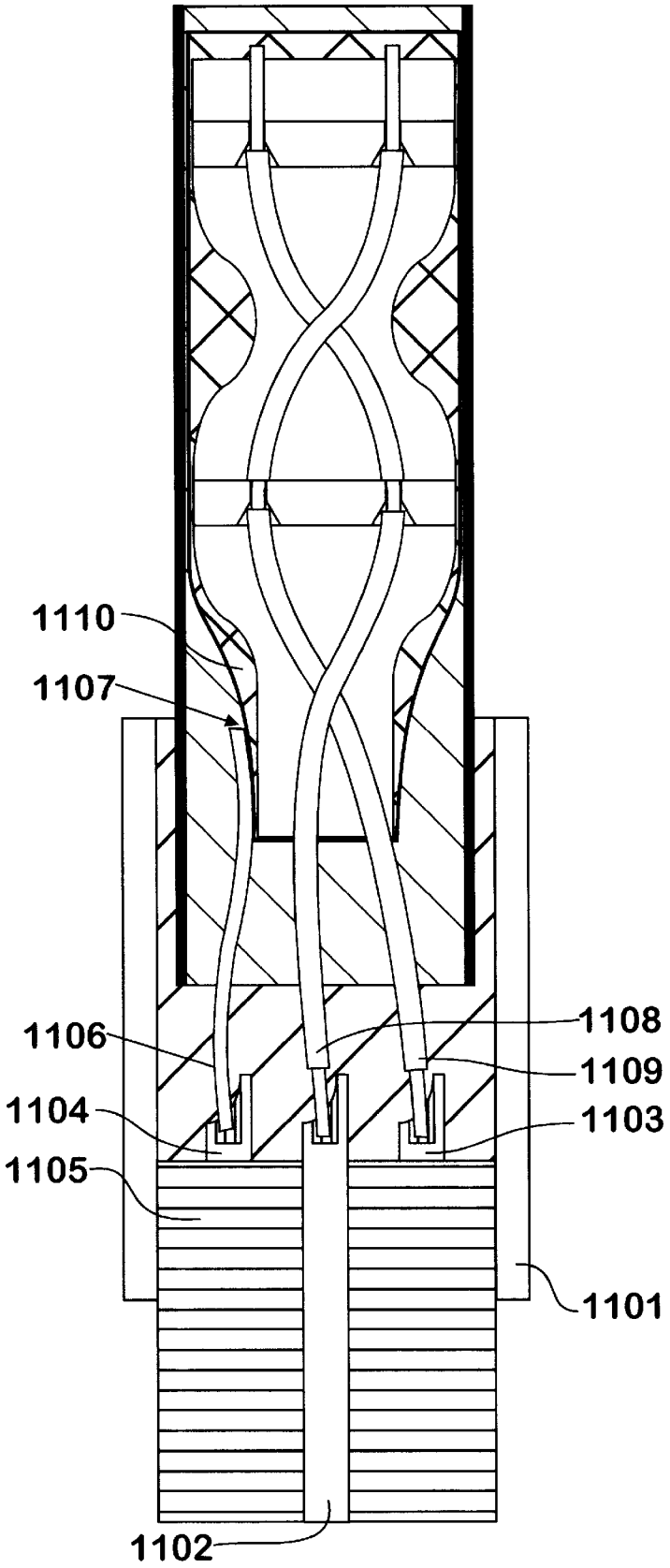
FIG. 11 illustrates a balanced female XLR termination to the present invention.
Figure 12D:
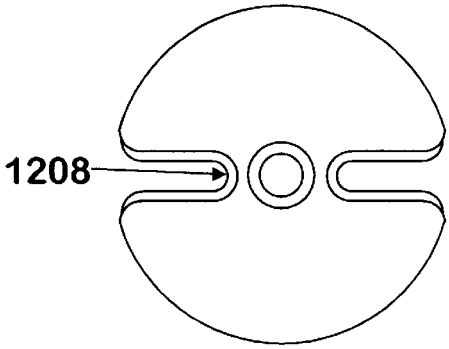
FIG. 12 illustrates an alternative embodiment of the internal subassembly utilizing spacers that are attached to each other forming a continuous assembly.
Figure 12C:
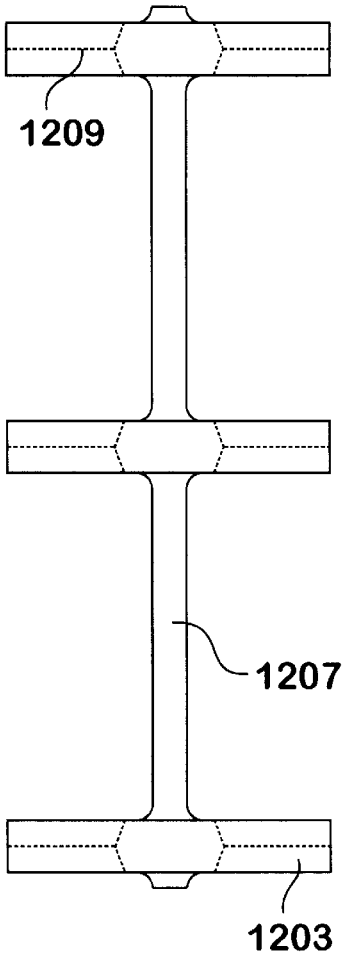
Figure 12B:
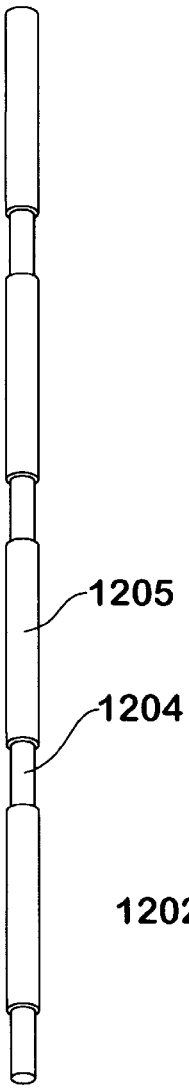
Figure 12A:
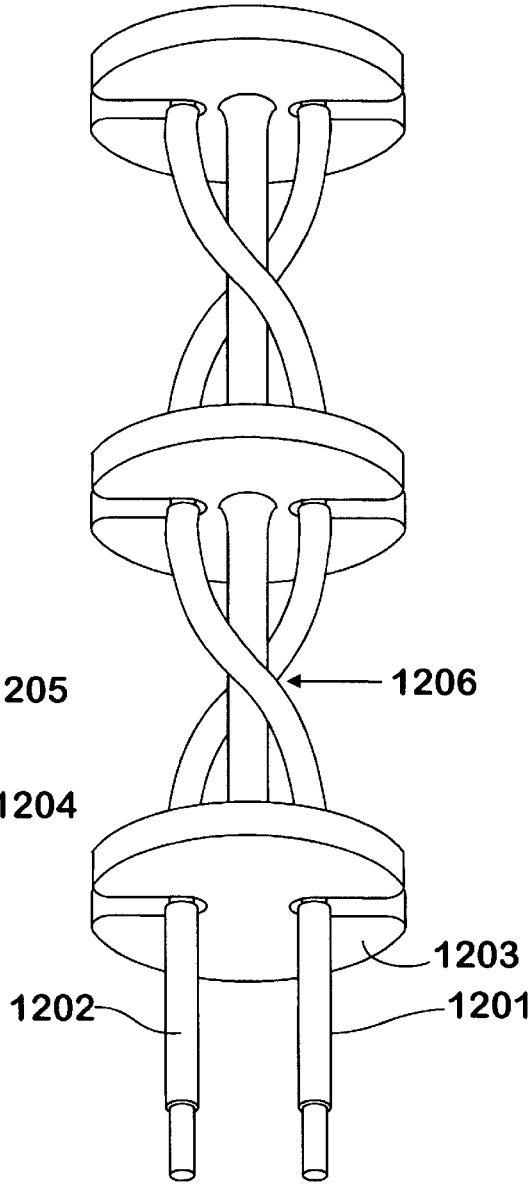

FIG. 11 illustrates a cutaway view of a balanced XLR connector termination as applied to the designated source/driving end of the present invention. Referring to FIG. 11, the female XLR-type connector 1101 terminates both signal conductors 1108 and 1109 and the overall shield 1110. Three contact sockets 1102, 1103 and 1104 are held in an insulating slug 1105. The positive and negative signal conductors 1108 and 1109 terminate respectively into sockets 1102 and 1103. The shield/ground conductor is terminated to socket 1104 using conductor 1106. Conductor 1106 is electrically connected to the shield 1110 at 1107. Some types of shields already have an integral drain-wire. In this case, the drain wire is terminated to pin 1104. Other shields are composed entirely of helically wrapped wires. These can generally be directly terminated to socket 1104.

What is claimed is:

1. An interconnect for conveying at least one channel of signal from a first component to a second component comprising:

a first signal conductor for routing a forward signal between said first component and said second component;

a second signal conductor for routing a return signal between said first component and said second component;

a plurality of insulating spacers having at least two holes that said first and second signal conductors pass through providing support for said first and second signal conductors and being located at substantially uniform intervals along the axis of said interconnect, said intervals between adjacent pairs of said spacers consisting of substantially gaseous dielectric and said holes in said spacers being located to separate said first and second signal conductors;

a plurality of insulating tubing sections alternately disposed on said first and second signal conductors in the intervals between adjacent pairs of said spacers along the axis of said interconnect thereby insulating only one of said first or second signal conductors in each of said intervals;

an insulating sheath surrounding said first and second signal conductors, said insulating tubing sections and said spacers;

an overall shield conductor surrounding said insulating sheath for shielding said first and second signal conductors, wherein said first and second signal conductors are unsupported and twisted together at an angle ranging from 180 degrees to 360 degrees between each adjacent pair of said spacers causing said first and second conductors to come in contact or close proximity with each other approximately half-way between each adjacent pair of said spacers.

2. An interconnect sub-assembly for conveying at least one channel of signal from a first component to a second component comprising:

a first signal conductor for routing a forward signal between said first component and said second component;

a second signal conductor for routing a return signal between said first component and said second component;

a continuous insulating rod with a series of integral insulating spacers being molded at uniform intervals concentric with said rod, each said spacer having at least two slots that said first and second signal conductors pass through, said rod being smaller diameter than said spacers, forming a continuous suspension means for said first and second signal conductors, wherein said first and second signal conductors are unsupported and twisted around said integral rods at an angle ranging from 180 to 360 degrees between each adjacent pair of said spacers.

* * * * *